US009802133B2

(12) United States Patent
Parlane et al.

(10) Patent No.: US 9,802,133 B2
(45) Date of Patent: Oct. 31, 2017

(54) FLOATING SHEET WAVE WATER ATTRACTION

(71) Applicant: VOLTUS INDUSTRIES LTD., Kelowna (CA)

(72) Inventors: Laurence Austin James Parlane, Kelowna (CA); Daniel Paul Benson, Kelowna (CA)

(73) Assignee: Voltus Industries Ltd., Kelowna (CA)

( * ) Notice: Subject to any disclaimer, the term of this patent is extended or adjusted under 35 U.S.C. 154(b) by 0 days.

(21) Appl. No.: 15/232,495

(22) Filed: Aug. 9, 2016

(65) Prior Publication Data

US 2017/0036124 A1 Feb. 9, 2017

Related U.S. Application Data

(60) Provisional application No. 62/202,878, filed on Aug. 9, 2015.

(51) Int. Cl.

| | |
|---|---|
| ***A63G 31/00*** | (2006.01) |
| ***E04H 4/00*** | (2006.01) |
| *B63B 35/44* | (2006.01) |
| *B63B 35/85* | (2006.01) |

(52) U.S. Cl.

CPC ..... *A63G 31/007* (2013.01); *E04H 4/0006* (2013.01); *E04H 4/0012* (2013.01); *B63B 2035/855* (2013.01)

(58) Field of Classification Search

CPC ..... A63G 21/00; A63G 21/16; A63G 21/18; A69B 69/00; A69B 69/0093; A47K 3/00; A47K 3/10; A63B 5/00; A63B 5/11; B63B 35/44; B63B 35/4413

USPC ..... 472/13, 117, 128, 129, 134; 405/78, 79; 4/491; 114/264, 266

See application file for complete search history.

(56) References Cited

U.S. PATENT DOCUMENTS

| | | | | |
|---|---|---|---|---|
| 6,676,530 | B2 * | 1/2004 | Lochtefeld | A63B 69/0093 472/117 |
| 6,773,355 | B1 * | 8/2004 | Lekhtman | B63B 3/08 472/128 |
| 6,964,069 | B2 * | 11/2005 | English | A63B 69/0093 114/382 |
| 7,351,011 | B2 * | 4/2008 | Wang | F16L 55/30 138/97 |
| 7,951,011 | B2 * | 5/2011 | Lochtefeld | A63G 21/18 472/117 |
| 2002/0185049 | A1 * | 12/2002 | Broderick | A63B 5/11 114/264 |
| 2015/0057093 | A1 * | 2/2015 | Murphy | E04H 4/0006 472/128 |

* cited by examiner

*Primary Examiner* — Kien Nguyen
(74) *Attorney, Agent, or Firm* — Antony C. Edwards

(57) ABSTRACT

A sheet wave water attraction includes a buoyant structure adapted for floating on a naturally occurring body of water, a sheet wave generator mounted to the structure, and a wave-forming ramp on the structure cooperating with the wave generator for the formation of waves on the ramp. The wave generator has a water intake below a waterline on the structure. The intake is configured to draw water from the body of water adjacent the structure. The buoyant structure has a shallow draft, including the draft of a water intake for the wave generator whereby near-coastal off-shore positioning may be achieved for operationally positioning the water attraction close to shore.

15 Claims, 6 Drawing Sheets

FLOATING SHEET WAVE WATER ATTRACTION

CROSS REFERENCE TO RELATED APPLICATIONS

This application claims priority from U.S. Provisional Application No. 62/202,878 filed on Aug. 9, 2015 and entitled: "Floating Sheet Wave Water Attraction", the entirety of which is incorporated herein by reference.

FIELD OF THE INVENTION

This invention relates to water attractions having sheet wave generators for producing a wave on a ramp for surfing and board riding. In particular this invention relates to such a water attraction which floats in a naturally occurring body of water.

BACKGROUND

Sheet wave water attractions were pioneered as a water ride designed to give users the experience of riding a perfect wave on a board. The concept of a sheet wave water attraction is based on a design that uses a water delivery system to pump a high volume of water through a nozzle. The nozzle is designed to shape the flow of water into a sheet formation, which then flows over a ramp. The ramp typically increases in elevation as it extends away from the nozzle and causes the sheet of water to simulate the shape of a wave. A user may ride a board on the sheet wave that flows over the ramp.

The Flowrider™ is one provider of a conventional sheet wave water attraction. In the last decade other companies such as Pacific Surf Designs™ and Murphys Waves™ have created other sheet wave products which resemble the Flowrider sheet wave water attraction.

The problem with these sheet flow water attractions is that they require significant infrastructure, including a pool or container of water, water chlorinating systems, water heating systems, piping and, typically, the construction of a custom built container or other housing structure. It is up to the purchaser of conventional water attractions to hire contractors and/or engineers to construct the necessary infrastructure.

Due to these expensive infrastructure requirements a sheet wave water attraction typically may only be installed in specific locations and at relatively great cost. These requirements make getting requisite approvals for land use, purchasing, and installing one of these sheet wave water attractions difficult. Consequently, there is a need in the industry for a sheet wave attraction that is more affordable, that does not need dedicated land usage, and that does not require the construction of such complex infrastructure.

In the prior art, the applicant is aware of the following patents and published patent applications: U.S. Pat. No. 6,964,069, which issued on Nov. 15, 2005, to Anthony Thomas English and Anthony Nathaniel English, entitled: "Floating Wave Making Apparatus"; U.S. Pat. No. 5,171,101, which issued on Dec. 15, 1992, to Light Wave, Ltd., entitled: "Surfing-wave Generators"; U.S. patent application Ser. No. 14/052,726, which was published on Apr. 17, 2014, under publication no. 2014-0106890 to Pacific Surf Designs, Inc., entitled: "Water Attractions Involving a Flowing Body of Water"; U.S. patent application Ser. No. 12/074,849, which was published on Nov. 20, 2008, under publication no. 2008-0286048 to Brandon Carnahan and Richard Carnahan, entitled: "Sheet Flow Water Ride Apparatus and Method"; U.S. Pat. No. 5,401,117, which issued on Mar. 28, 1995, to Thomas J. Lochtefeld, entitled: "Method and Apparatus for Containerless Sheet Flow Water Rides"; Canadian Patent No. 2,005,916, which issued on Oct. 24, 2000, to Charles E. Sauerbier and Thomas J. Lochtefeld, entitled: "Improvements in Surfing-wave Generators"; and U.S. Pat. No. 5,738,590, which was issued Apr. 14, 1998, to Thomas J. Lochtefeld, entitled: "Method and Apparatus for a Sheet Flow Water Ride in a Single Container".

SUMMARY OF THE INVENTION

The floating sheet wave water attraction is similar to other sheet wave water attractions in the way that it uses a water delivery system to pump a sheet of water over a ramp to create a rideable surface simulating a wave. However, in the present invention the sheet wave water attraction draws water from, and floats on, a naturally occurring body of water. The water attraction may float on a naturally occurring body of water such as, but not limited to, a lake, river, man-made reservoir or man-made lake (for the purpose herein both considered to fall within the definition of naturally occurring body of water) or the ocean. The water attraction according to the present invention uses the body of water on which it floats as the water source for the wave generator which creates a sheet wave for boardriding such as surfing. This eliminates the need for the construction of additional expensive infrastructure to create a closed loop circuit that uses reservoir containers and piping to chlorinate and cycle the water.

In use, the natural waves and swells acting on the surface of the naturally occurring body of water will cause the floating water attraction to sway and undulate in accordance with its dynamic response according to the force and frequency of the waves and swells, which adds a unique and potentially challenging element to the boardriding experience as the sheet waves generated by the wave generator on the water attraction exhibit responsive characteristics in response to the natural waves which heretofore are unknown in the static wave generators in the prior art. Preferably, the present disclosure is mobile, and advantageously is modular, being made up of individually buoyant sections. This makes for simpler set up and take down of the water attraction, and facilitates moving the water attraction to different locations on the body of water, for example by towing or under its own power.

In an embodiment of the present disclosure, a sheet wave water attraction comprises a buoyant structure adapted for floating on a naturally occurring body of water, a sheet wave generator mounted to the structure, the wave generator having a water intake below a waterline on the structure and configured to draw water from the body of water adjacent the structure, and a wave forming ramp on the structure cooperating with an outflow sheet wave-forming nozzle on the sheet wave generator. In other aspects, the buoyant structure has a draft, including a draft of the water intake, which extends less than substantially four feet below the waterline, whereby near-coastal off-shore positioning may be achieved for operationally positioning the water attractions close to shore. In other embodiments, the draft is less than substantially three feet.

In other aspects of the present disclosure, the intake has an intake opening which is adjacent an underside of the structure. In still other embodiments, not intended to be limiting, the intake opening is at least in part substantially flush with the underside of the structure. Other aspects of the present disclosure include the nozzle having a nozzle opening with a nozzle opening area dimension, and the intake having an intake opening with an intake opening area dimension, wherein the intake opening area dimension is greater than the nozzle opening area dimension. In other embodiments, an intake flow velocity of a water flow into the water intake of the apparatus is less than an output flow velocity of the sheet wave generator. In other embodiments, the flow rate of the water flow is selected from a range of flow rates substantially between 17,000 gallons per minute and 20,000 gallons per minute, and the intake opening area dimension is chosen, correspondingly, from the range of substantially 130 square feet to 170 square feet.

In other embodiments of the present disclosure, the structure may further comprise two or more modularized components having releasable couplings, wherein the two or more modularized components are releasably coupled to each other during operation of the sheet wave water attraction.

In some embodiments, the wave generator includes a pump and water flow from the nozzle is driven by an axial flow pump. In other embodiments, the structure is substantially a floating platform, and the ramp is substantially centered on the structure, wherein a wave formation of the ramp is substantially centered relative to a center of buoyancy of the attraction whereby the effect of undulations of the attraction due to waves and swells on the body of water symmetrically interact with the wave formation on the ramp irrespective of the direction of the waves and swells impacting the structure, relative to the structure.

In some embodiments of the present disclosure, a sheet wave water attraction is provided, comprising a frame adapted for floating on a body of water, wherein the body of water has a natural waterflow. A riding surface is mounted to the frame. A waterflow generator directs an artificial waterflow over the riding surface so as to generate a wave on the riding surface, the waterflow generator having a water intake providing a flow of water to supply the artificial waterflow. The water intake is in fluid communication with the body of water. The natural waterflow dynamically changes one or more characteristics of the artificial waterflow as the position of the structure changes in pitch, roll and yaw, and the rate of change of pitch, roll and yaw changes in reaction to the natural waterflow. In further embodiments of the present disclosure, the one or more characteristics of the artificial waterflow is selected from a group comprising: volume, direction, velocity, waveforms and wave amplitude. Other embodiments of the present disclosure further comprise one or more anchoring points for anchoring the structure in the body of water.

In other embodiments of the present disclosure, a sheet wave water attraction is provided, comprising a frame adapted to be situated in a body of water contained by ground; a riding surface mounted to the frame; a water delivery system mounted to the frame adjacent the riding surface, the system including at least a pump, a nozzle and a water intake in fluid communication with one another so as to direct a flow of water from the body of water over the riding surface so as to generate a wave, and thence to flow under the force of gravity back into the body of water.

In other aspects of the present disclosure, a method for positioning the sheet wave water attraction described above is provided, comprising the steps of: selecting a position in the body of water, the selected position having a sufficient clearance between the water intake and the bottom of the body of water or vegetation or debris on the floor under the body of water, so that the clearance accommodates at least a draft of the attraction; moving the sheet wave water attraction to the selected position; and anchoring the sheet wave water attraction at the selected position.

DETAILED DESCRIPTION

Figure 1:
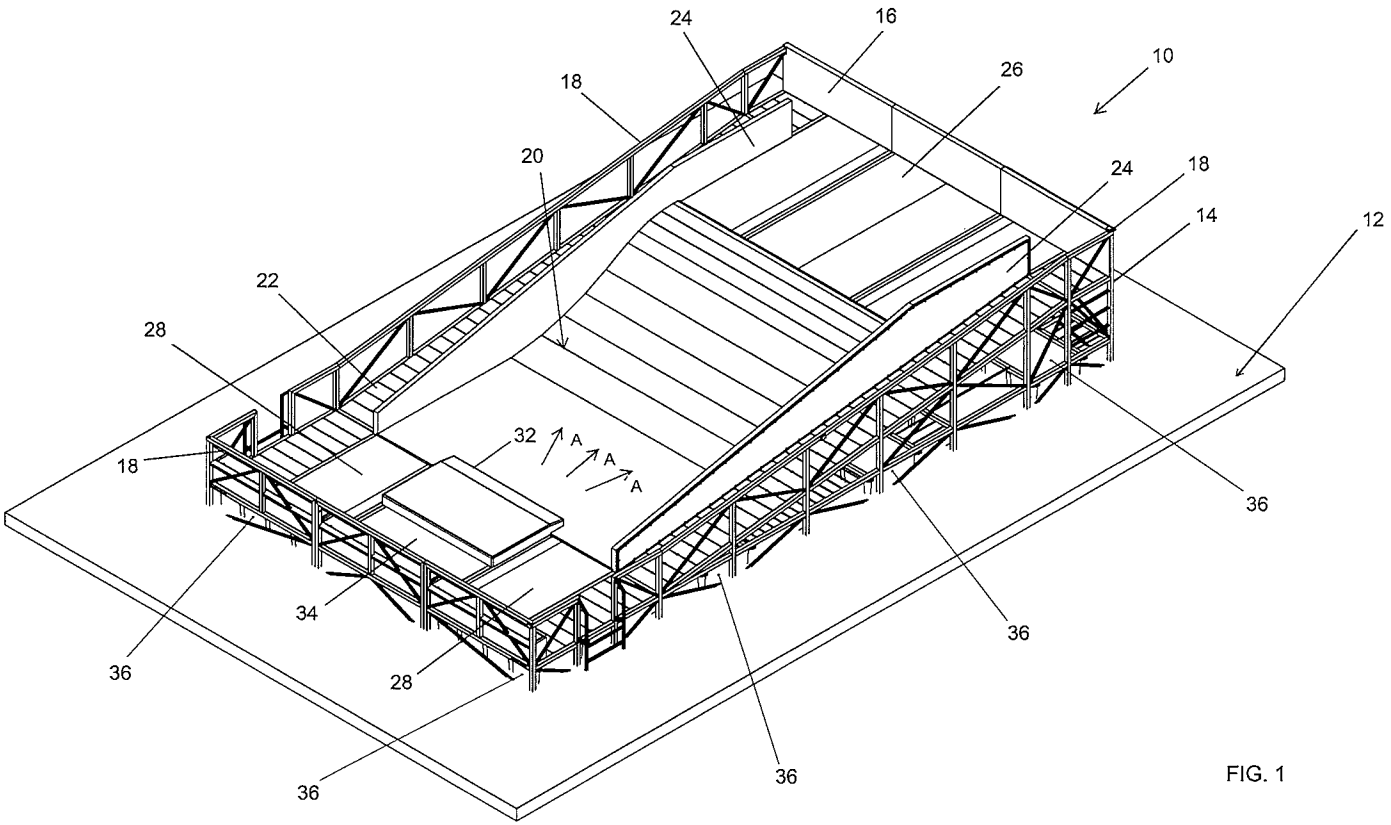
FIG. 1 is an isometric view of the water attraction according to one embodiment floating on an open body of water.
Figure 2:
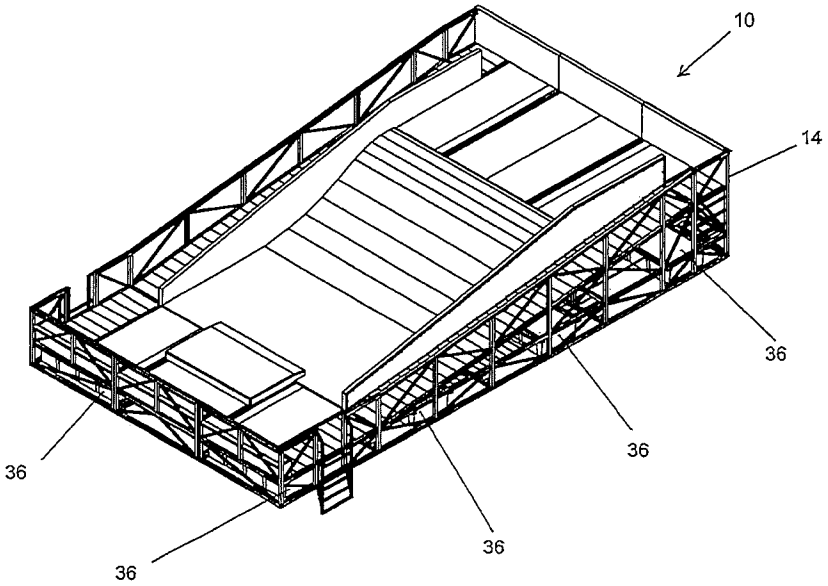
FIG. 2 is the view of FIG. 1, absent the body of water.
Figure 3:
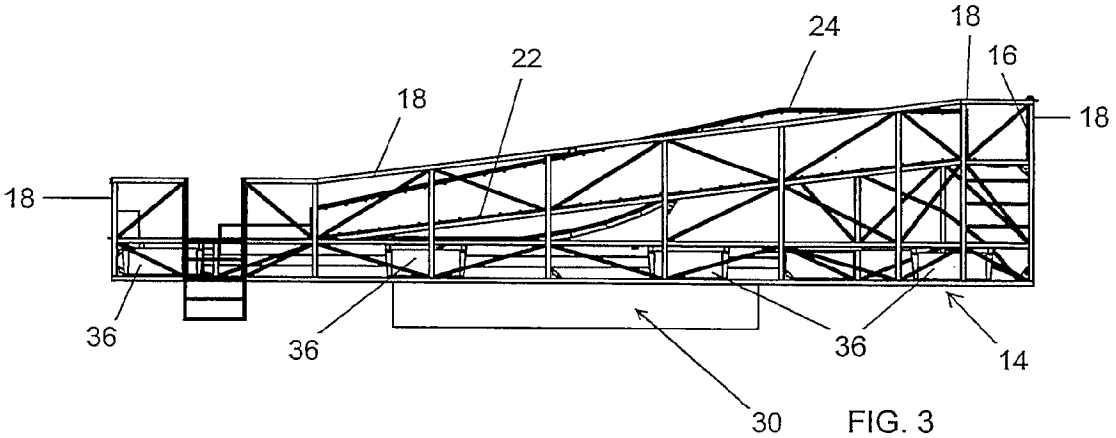
FIG. 3 is a side view of the water attraction of FIG. 1.
Figure 4:
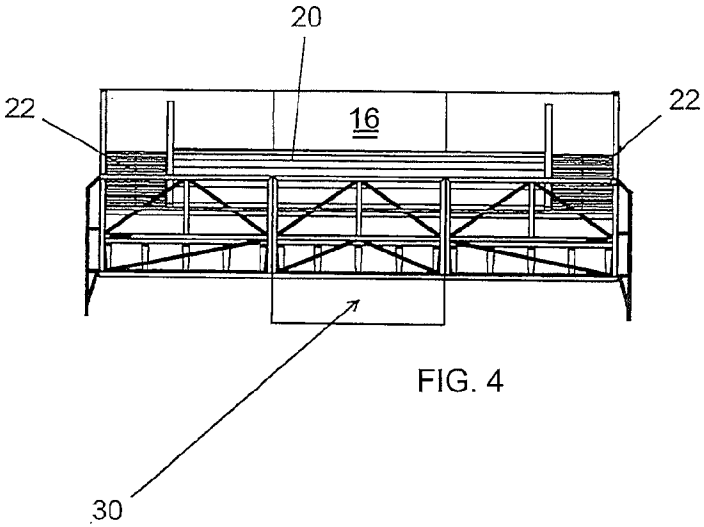
FIG. 4 is a front view of the water attraction of FIG. 1.

The following description of the preferred embodiment of the invention is not intended to limit the invention to this preferred embodiment, but rather is illustrative of aspects of the invention that may be found in other embodiments falling within the scope of the invention, and so as to enable a person skilled in the art to make and use this invention.

The floating sheet wave water attraction 10, floats on a naturally occurring body of water 12 and includes a structural frame 14 which serves as a foundation for buoyancy devices and at least one wave generator system. The frame 14 may be built out of aluminum or fiberglass or other structural materials, preferably which will not corrode or absorb water. Preferably also the frame 14 is relatively light-weight to decrease the required buoyancy. Padding 16 may be removably attached to the frame 14, for example along railings 18. A ramp 20 is mounted also atop the frame 14. The ride surface of ramp 20 may be made of a separate plastic material that is mounted to the frame components 14*a* underneath ramp 20. The surface material for ramp 20 would be known to one skilled in the art of constructing sheet wave generators and water attractions located on dry land.

Inclined walkways 22, which may, for example, include a set of stairs (not shown), extend along and laterally outside of the sidewalls 24 to allow users' access to the top platform 26. The walkway 22 may also be made of a plastic material and configured so as to allow water to drain through the walkway. The top platform 26 and the bottom platform 28 may have a grated or otherwise porous surface to allow the flow of water to fall back into the body of water 12. Platforms 26 and 28 may be padded to enhance safety and comfort for the users.

The sheet wave generator system (not shown with the exception of intake 30 and nozzle 32) draws water through intake 30 from the naturally occurring body of water 12. The intake 30 feeds an axial flow pump (not shown) which forces a volume of water, for example at a flow rate of between 17,000 and 20,000 gallons per minute, through shaped nozzle 32. The axial flow pump may be for example a Flygt™ 7000 series Column Pump, available presently from the Xylem™ Company, distributors of Flygt™ pumps. Other axial flow pumps, for example a diesel driven axial flow pump of sufficient capacity, may also work.

Nozzle 32 is shaped, as would be known to one skilled in the art, to shape the flow of water into a sheet which flows in direction A up the ramp 20 to form a sheet wave (not shown). The sheet wave is produced by the shape of the ramp 20 as the water flows over, and follows the contours of ramp 20 as would also be known to one skilled in the art. The sheet wave may then be used in a conventional manner to body-surf, or board, or conventionally surf in the manner of conventional sheet wave generators, with the exception of the unusual or unconventional wave forms caused by undulations of the floating water attraction 10 in the presence of waves or swells on body of water 12. After flowing up the ramp 20 the flow of water in direction A flows on to the top platform 26 and falls through its grated or porous surface to drop back into the naturally occurring body of water 12.

Vertical sidewalls 24 may be provided both for safety and to contain the flow of water pumped over ramp 20. Body surfing, boardriding or surfing is intended to take place on, aligned generally down the longitudinal length of, ramp 20 between sidewalls 24. Railing 18 on top platform 26 inhibits the users from being swept off the top platform by the flow of water coming off ramp 20.

The water delivery system pump may for example be located near the nozzle 32 or may be located under the ramp 20 structure 14*a*. The pump and the balance of the water delivery system may be hidden from view by a housing 34.

The floating sheet wave water attraction 10 is mobile in one preferred embodiment. Advantageously it may also be modular for ease of setup, takedown and storage. Being modular allows for ease of transport if another location is desired and transport by water is not possible or desirable. In the modular embodiment, structure or frame 14 is produced in multiple sections. Each individual section has floats 36 or other forms of buoyancy as would be known to one skilled in the art in order to make the water attraction self-buoyant, and sufficiently buoyant to support not only the dry weight of the water attraction but also the weight of the on-board water, including the sheet wave, and the weight of the users.

Figure 5:
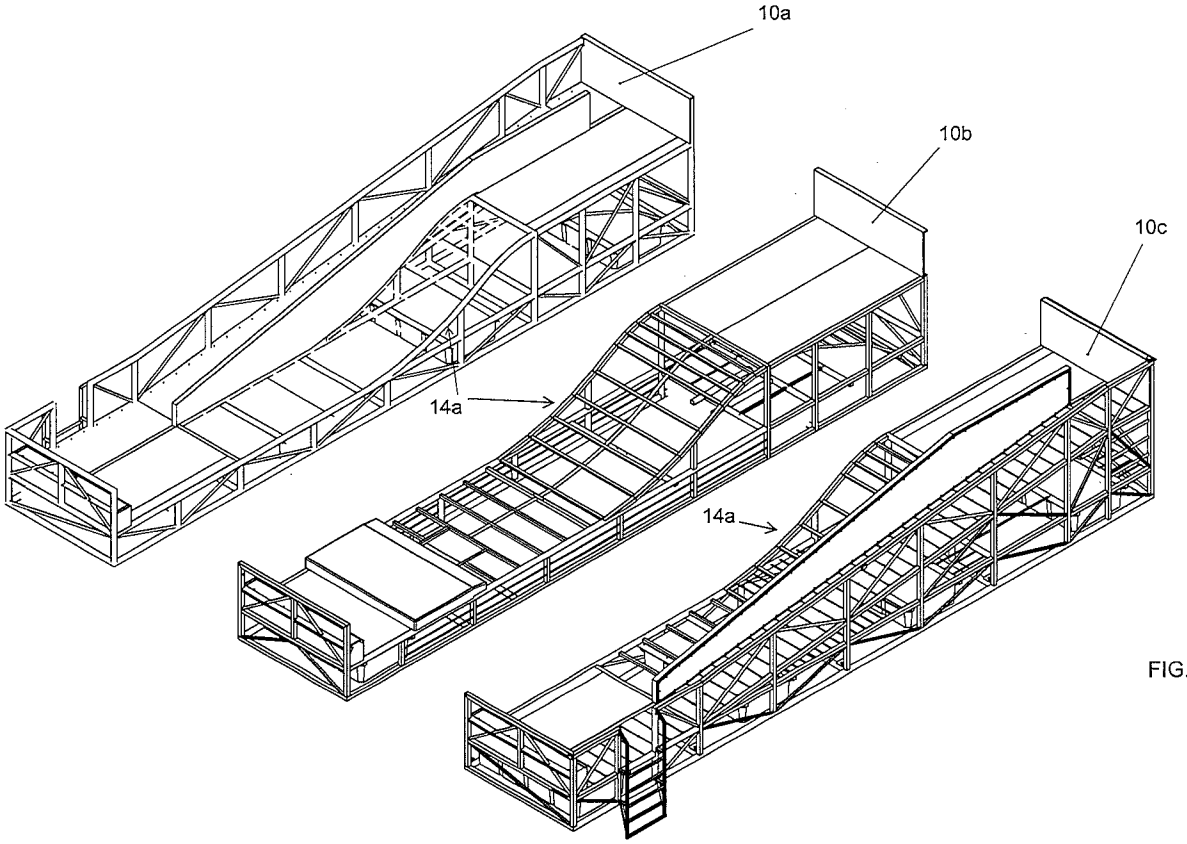
FIG. 5 shows the water attraction of FIG. 2 in partially cutaway view to show individual buoyant modular sections.
Figure 6:
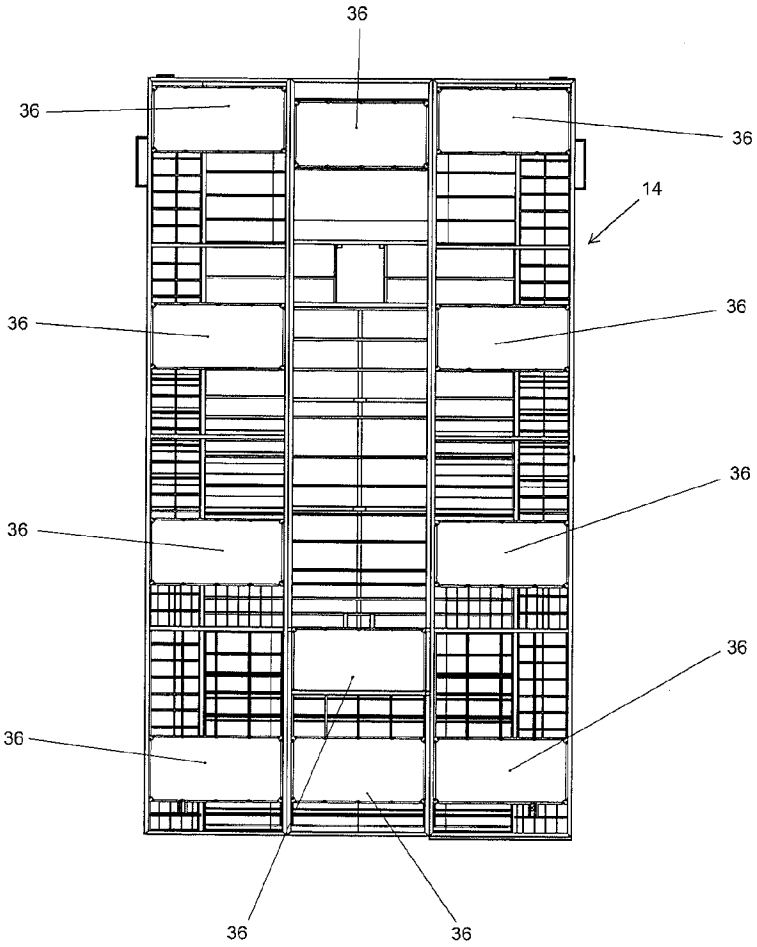
FIG. 6 is a bottom view of the water attraction of FIG. 1 with the intake not shown.
Figure 7:
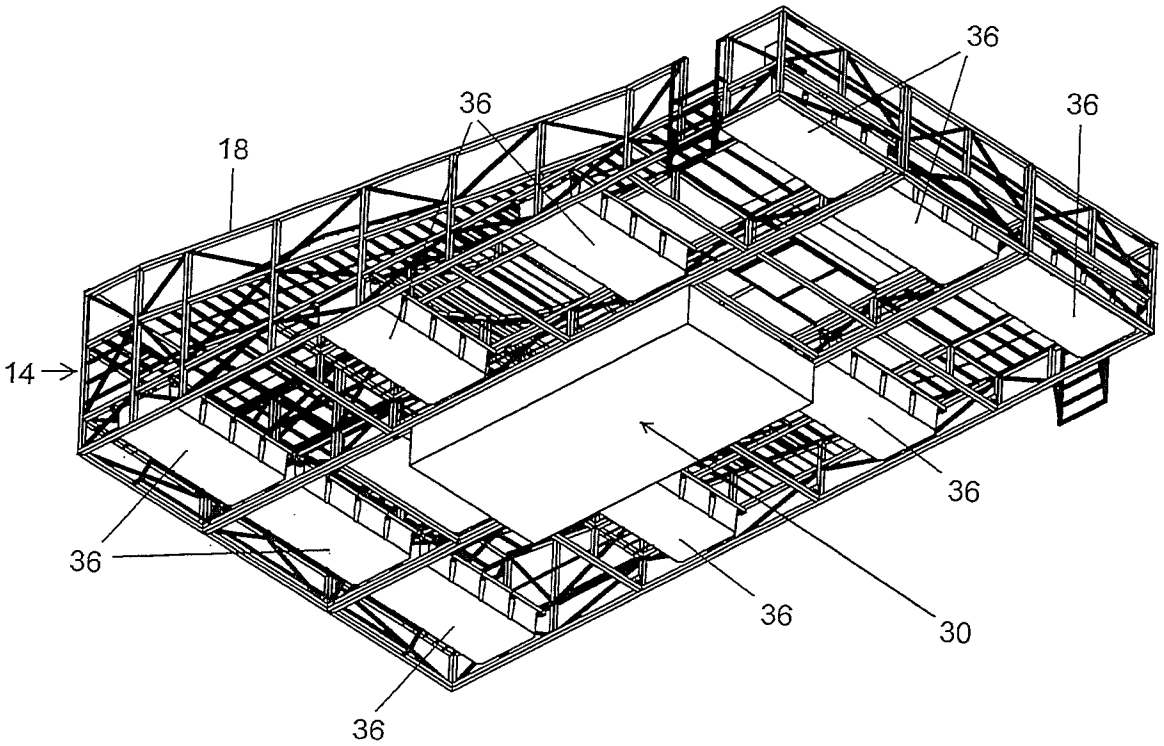
FIG. 7 is a bottom perspective view of the water attraction of FIG. 2.

The embodiment illustrated has three individual sections as seen in FIG. 5, although this is not intended to be limiting, as more or fewer sections would also work. Thus left, center, and right sections 10*a*, 10*b*, 10*c* are provided respectively. More sections may be added or removed as necessary to increase or decrease the overall size of the structure. Advantageously, each section has a height, length, and width which allows for the individual sections to be transported by truck and trailer. The purpose of this modular construction is to make the transport and setup of the water attraction simple, fast, and inexpensive. Once assembled, the water attraction may, for example, have a length of 45 feet, a width of 25 feet, and a height (including below the waterline to the bottom of frame 14) of approximately 9.5 feet.

When setting up the floating sheet wave water attraction 10 at the desired location the individual sections 10*a*, 10*b*, 10*c* may be individually placed in the water because they are self-buoyant and advantageously self-righting. Once all of the individual sections are in the water they can then be pieced together and releasably fastened, or coupled, to one another to complete their assembly. The floating sheet wave water attraction 10 is mobile because it can be easily disassembled, transported to desired location and then reassembled. The water attraction may also be transported by towing, without disassembly, to different locations on the same body of water 12.

In alternative embodiments the water attraction may be self-powered, for example, by the use of conventional nautical-use motors or engines or, for example, by the redirection of some or all of the throughput of the on-board water pump via directional steering nozzles (not shown) mounted to or under the structure. The water attraction may thus be propelled over the body of water by steering inputs to change the orientation of the steering nozzles relative to the structure and relative to the body of water.

The water attraction will be positioned in an advantageous location on the body of water, and moored to secure it from drifting. Moorage may be accomplished by the conventional use of an anchor or multiple anchors, and corresponding anchor lines secured to the frame 14. Because the water attraction is intended in many instances to be used by the public, for example on a pay-for-ride basis, a preferred location for the water attraction is near to shore. Consequently, a shallow draft, for example in the order of three to four feet, is desirable. This however poses a problem in the design of intake for the wave generator pump.

Depending on the size of the surface area of ramp 20, a sheet wave requires a considerable mass or volumetric flow rate of water being pumped over the ramp. For example, applicant expects that in one embodiment the axial pump in the wave generator must move a volume of water in the order of 17,000 to 20,000 gallons per minute for a water attraction having overall frame dimensions of the aforementioned approximately 45 feet length by 25 feet width by 9.5 feet height.

This volume of water must then be supplied through the pump's intake. However, regulatory guidelines, which will change depending on the locale and jurisdiction, may dictate the required size of screened intake relative to the volumetric flow rate through the intake. For example, in the case of Okanagan Lake in British Columbia, Canada, the regulatory requirements are described in guidelines published by the Canadian Federal Department of Fisheries and Oceans, entitled *Freshwater Intake End-of-Pipe Fish Screen Guideline* (DFO5080, dated March 1995), which provides a table correlating intake pipe inflow rates with a corresponding intake screen area. Scaling up the table rates to the aforementioned range of volumetric flow rates (17,000-20,000 gpm) resulted in a corresponding open intake screen area of approximately 110 to 135 square feet respectively, the open intake screen area being defined as the total area of the openings in the screen (which area excludes the material of the screen itself). The effective intake screen area, defined as the area of screen material, required is dependent on the type of screen material used; for example, a screen material comprising 80% open area would result in requiring an effective intake screen area of approximately 130 to 170 square feet, for volumetric flow rates in the range of 17,000 gpm to 20,000 gpm. The challenge, then, is to provide such a large effective intake screen area while still achieving a minimal or shallow draft, so that close-to-shore operations are feasible. The resulting design, as illustrated, is to at least partially flush mount the intake 30 under the structure of frame 14, for example centered as illustrated.

Intake 30 is shown as a rectangular prism, however this is not intended to be limiting, as other two or three dimensional shapes will work and still achieve the desired shallow draft, keeping in mind that typically a clearance is required between the intake screen and the floor or bed of the lake or ocean, so as to minimize the clogging of the intake screen and ingestion of silt. Thus, the moorage depth must provide for the draft, including the weight of the on-board, above water-line water, and the weight of all users onboard, and also has to provide for the desired clearance between the intake screen and floor or bed of the water body, and also allow for the rise and fall of the water attraction due to waves and swells on the water body and tidal action as the case may be.

In a further aspect, in locations where waves and swells on the body of water may be considerable, which may cause excessive pitch, roll and/or yaw (or excessive rate of change of these) of the floating water attraction, dampeners or other means for dampening the pitch, roll or yaw of the water attraction, may be desirable. For example, spring lines may be employed for the moorage lines (where moored for example to pilings) or for the anchor lines (where positioned using anchors) or combinations of these. Other dampeners, such as sea anchors are known in the art and may be employed to control pitch, roll and yaw of the water attraction beyond that which provides entertaining or challenging waveforms as the sheet wave interacts dynamically with the waves or swells on the body of water.

As a person skilled in the art will recognize from the detailed description and from the figures and claims, modifications and changes can be made to the preferred embodiment of the invention without departing from the scope of this invention. The invention should not be limited by the above described embodiment, method, and examples, but by all embodiments and methods within the scope of the invention.

What is claimed is:

1. A sheet wave water attraction, comprising:

a buoyant structure adapted for floating on a naturally occurring body of water, a sheet wave generator mounted to the structure, the wave generator having a water intake below a waterline on the structure and configured to draw water from the body of water adjacent the structure, a wave forming ramp on the structure cooperating with an outflow sheet wave-forming nozzle on the sheet wave generator, wherein the structure is substantially a floating platform, and wherein the ramp is substantially centered on the structure wherein a wave formation of the ramp is substantially centered relative to a center of buoyancy of the attraction whereby the effect of undulations of the attraction due to waves and swells on the body of water symmetrically interact with the wave formation on the ramp irrespective of the direction of the waves and swells impacting the structure, relative to the structure.

2. The apparatus of claim 1, wherein the buoyant structure has a draft, including a draft of the intake, which extends less than substantially four feet below the waterline, whereby near-coasted off-shore positioning may be achieved for operationally positioning the water attraction close to shore.

3. The apparatus of claim 2 wherein the draft is less than substantially three feet.

4. The apparatus of claim 1 wherein the intake has an intake opening which is adjacent an underside of the structure.

5. The apparatus of claim 4 wherein the opening is at least in part substantially flush with the underside of the structure.

6. The apparatus of claim 1 wherein the nozzle has a nozzle opening having a nozzle opening area dimension, and wherein the intake has an intake opening having an intake opening area dimension, and wherein the intake opening area dimension is greater than the nozzle opening area dimension.

7. The apparatus of claim 6, wherein an intake flow velocity of a water flow into the water intake is less than an output flow velocity of the sheet wave generator.

8. The apparatus of claim 7, wherein the flow rate of the water flow is selected from a range of flow rates substantially between 17,000 gallons per minute and 20,000 gallons per minute, and the open intake screen area dimension is chosen, correspondingly, from the range of substantially 110 to 135 square feet.

9. The apparatus of claim 1, wherein the structure is modular in construction and includes two or more modularized components and wherein during operation, the two or more modularized components are releasably coupled to each other to form the structure.

10. The apparatus of claim 1, wherein the wave generator includes a pump and wherein water flow from the nozzles driven by an axial flow pump.

11. A sheet wave water attraction apparatus, comprising:

a structure adapted for floating on a body of water, the body of water having a natural waterflow, a riding surface mounted to the structure, a waterflow generator directing an artificial waterflow over the riding surface so as to generate a wave on the riding surface, the waterflow generator having a water intake providing a flow of water to supply the artificial waterflow, the water intake in fluid communication with the body of water, wherein the natural waterflow dynamically changes one or more characteristics of the artificial waterflow as the position of the structure changes in pitch, roll and yaw, and the rate of change of these changes, in reaction to the natural waterflow, wherein the structure is substantially a floating platform, and wherein the ramp is substantially centered on the structure, wherein a wave formation of the ramp is substantially centered relative to a center of buoyancy of the attraction whereby the effect of undulations of the attraction due to waves and swells on the body of water symmetrically interact with the wave formation on the ramp irrespective of the direction of the waves and swells impacting the structure, relative to the structure.

12. The apparatus of claim 11, wherein the one or more characteristics of the artificial waterflow is selected from a group comprising: volume, direction, velocity, waveforms, wave amplitude.

13. The apparatus of claim 11, further comprising one or more anchoring points for anchoring the structure in the body of water.

14. A sheet wave water attraction apparatus, comprising:

a structure adapted to be situated in a body of water contained by ground, a riding surface mounted to the structure, a water delivery system mounted to the structure adjacent the riding surface, the system including at least a pump, a nozzle and a water intake in fluid communication with one another so as to direct a flow of water from the body of water over the riding surface so as to generate a wave, and thence to flow under the force of gravity back into the body of water, wherein the structure is substantially a floating platform, and wherein the ramp is substantially centered on the structure, wherein a wave formation of the ramp is substantially centered relative to a center of buoyancy of the attraction whereby the effect of undulations of the attraction due to waves and swells on the body of water symmetrically interact with the wave formation on the ramp irrespective of the direction of the waves and swells impacting the structure, relative to the structure.

15. A method for positioning the apparatus of claim 14, comprising:

selecting a position in the body of water, the position having a sufficient clearance between the water intake and a debris in the body of water, selecting a position in the body of water, the position having a sufficient clearance between the water intake and a floor under the body of water so as to accommodate at least a draft of the attraction, moving the sheet wave water attraction to the selected position, anchoring the sheet wave water attraction at the selected position.

* * * * *